US008177596B2

(12) United States Patent
McCammon

(10) Patent No.: US 8,177,596 B2
(45) **Date of Patent: *May 15, 2012**

(54) FISHING TRAWLER NET RESISTANT SUBSURFACE BUOY TETHER SYSTEM

(75) Inventor: Patrick R. McCammon, Leo, IN (US)

(73) Assignee: Skysight Technologies LLC, Fort Wayne, IN (US)

( * ) Notice: Subject to any disclaimer, the term of this patent is extended or adjusted under 35 U.S.C. 154(b) by 233 days.

This patent is subject to a terminal disclaimer.

(21) Appl. No.: 12/691,781

(22) Filed: Jan. 22, 2010

(65) Prior Publication Data

US 2011/0183555 A1 Jul. 28, 2011

(51) Int. Cl.
*B63B 22/18* (2006.01)

(52) U.S. Cl. ..... 441/23

(58) Field of Classification Search ..... 441/1, 3, 441/6, 7, 21, 22, 23, 30, 32; 114/294
See application file for complete search history.

(56) References Cited

U.S. PATENT DOCUMENTS

| | | | | |
|---|---|---|---|---|
| 3,590,408 | A * | 7/1971 | Verhagen | 441/23 |
| 4,220,421 | A | 9/1980 | Thorne | |
| 4,519,727 | A | 5/1985 | Mitchell et al. | |
| 4,881,483 | A * | 11/1989 | Wood | 114/294 |
| 5,443,408 | A * | 8/1995 | Kimball | 441/22 |
| 5,913,670 | A | 6/1999 | Anderson et al. | |
| 6,457,896 | B1 | 10/2002 | deDoes | |
| 6,685,518 | B1 | 2/2004 | Goudey | |
| 7,390,143 | B1 | 6/2008 | Tenbusch, II | |
| 2004/0073088 | A1 | 4/2004 | Friedman et al. | |

* cited by examiner

*Primary Examiner* — Daniel Venne
(74) *Attorney, Agent, or Firm* — Brooks Kushman P.C.

(57) ABSTRACT

An anchoring base and a buoy that are adapted to resist entanglement with a trawler net that may be dragged over the anchor and buoy. The buoy may have a plurality of cones that are secured to the tether in a spaced relationship proximate the lower end of the buoy. The anchoring base has a top side having an upper surface that defines a plurality of indentations between raised portions. The tether may be received in at least one of the indentations when the tether is pressed against the upper surface of the insert to protect the tether from being damaged or severed.

13 Claims, 4 Drawing Sheets

FISHING TRAWLER NET RESISTANT SUBSURFACE BUOY TETHER SYSTEM

BACKGROUND OF THE INVENTION

1. Field of the Invention

An anchoring base and a buoy that are adapted to resist entanglement with a trawler net or other foreign object that is dragged over the anchor and buoy.

2. Background Art

Buoys are floating members that are tethered to an anchor on the ocean floor. Some buoys are subsurface buoys that may be used for acoustic sensing systems. Such buoys may also be used for other purposes or with other types of sensing systems or transmitting systems.

A problem associated with subsurface buoys is that they may become entangled in or be damaged by nets used by fishing trawlers. Such buoys are normally secured by a cable, or tether, to a base. The base is generally formed of a heavy material, such as concrete, iron or steel. The tether is generally a wire cable or chain that is secured to the base by a cable clamp or is otherwise tied to the base. In the case of buoys with sensors, the tether normally includes an electrical cable with conductors inside the tether. When a heavy foreign object or fishing net component is dragged over the base, the tether may be pinched against the top of the base and severed resulting in the buoy being cut free from the base.

Applicant's developments as summarized below are directed to addressing the above problems with buoys, tethers and anchoring bases.

SUMMARY OF THE INVENTION

Applicant has conceived of a trawler net resistant tether system for a buoy that is tethered to an anchoring base. The system features several different ways to protect the buoy to reduce the risk of entanglement with trawler nets. The system also features an anchoring base that is designed for trawler nets to slide over the top of the base and includes a top surface that affords protection to the tether.

One approach to protecting the buoy is to provide a plurality of concentric cones in conjunction with the buoy that causes the buoy to pivot from a generally vertical orientation to a generally horizontal orientation as a trawler net pulls the tether down and slides across the buoy when it is on the ocean floor. As used herein, the term "generally vertical" refers to the orientation assumed by the buoy when floating above the base and it should be understood that the buoy may deviate from a strictly vertical orientation due to undersea currents, forces applied to the buoy by the tether, and the like. The term "generally horizontal" refers to the horizontal plane of the sea floor but should not be construed to require a strictly horizontal orientation due to the fact that the ocean floor has a varied topography.

One embodiment of a buoy that is resistant to entanglement with a trawler net may comprise an anchor and a tether secured to the anchor on a lower end of the tether. The buoy may have a lower end that is secured to the tether on an upper end of the tether. The buoy may be provided with a plurality of cones that are disposed about the tether in a spaced relationship proximate the lower end of the buoy. The lower end of the buoy is nested within a first cone and the first cone is nested within at least one additional cone. The cones cooperate to prevent the buoy from becoming entangled with the trawler net as the trawler net traverses the tether and then the buoy by reorienting the buoy from a generally vertical orientation to a generally horizontal orientation.

According to other aspects of the above embodiment of the buoy provided with the nested cone guard, the additional cone may be a second cone that is nested within a third cone. The first cone may engage the buoy and the additional cones may engage the next cone closer to the buoy when the trawler net traverses the tether and the cones. The tether may be an elongated flexible member having a longitudinal axis that is normally vertically oriented when the buoy is allowed to float. The cones prevent the buoy from being oriented relative to the longitudinal axis of the tether. The cones provide a segmented ramp surface that is traversed by the trawler net.

An anchoring base is also disclosed that protects a tether that is attached to the base. According to this aspect of applicant's development, a body is provided that has an upper surface that defines a plurality of indentations between raised portions that extend above the wall. The tether is secured to the body and may be received in the indentations in the event the tether is pressed against the upper surface of the body to protect the tether from being pinched and damaged or severed against the body.

According to other aspects of the above anchoring base the body may have an outer wall that raises a foreign object over the body as the foreign object traverses the body in a lateral direction. Examples of foreign objects may include doors on opposite sides of the net, the foot rope, a tickler chain, weights, or other objects entrained within the net. An insert may be provided that is secured within a recess defined by a wall of the body. The upper surface of the insert may provide the raised portions and indentations on the upper surface of the body. The raised portions of the upper surface may be partially spherical in shape or may have a different shape.

According to another aspect of applicant's development, a buoy system is disclosed that offers many of the features of the above concepts. The system comprises a base having a top side that is defined by a wall extending about the base. A guard is disposed on the top side that defines a plurality of indentations between raised portions that extend above the wall. A tether is attached on a lower end to the base. A buoy is attached to an upper end of the tether at a spaced location relative to the base. Means are provided for reorienting the buoy from a generally vertical orientation to a generally horizontal orientation in the event an object is dragged over the base, tether and buoy. The tether may be received in the indentations when the tether is pressed against the top side of the base to protect the tether from being pinched against the wall extending about the body. The buoy is prevented from becoming entangled with the object as the object traverses the base, the tether and the buoy.

According to additional aspects of the above system, the buoy system may include a buoy having a lower end that is secured to the tether on an upper end of the tether. The buoy may include a housing and a sensing system that is at least partially enclosed within the housing.

Alternatively, the means for reorienting the buoy in the above system may include a plurality of cones that, in one embodiment, are disposed about the tether in a spaced relationship proximate the lower end of the buoy. In another embodiment, the top cone may be attached to the buoy with the other cones being connected to the top cone without being attached directly to the tether. The lower end of the buoy may be nested within a first cone that is nested within at least one additional cone. The cones cooperate to prevent the buoy from becoming entangled with the trawler net as the trawler net traverses the tether and then the buoy by reorienting the buoy to a generally horizontal orientation.

The first cone may engage the buoy with the additional cones engaging the next cone closer to the buoy when the trawler net traverses the tether and the cones.

These and other aspects of applicant's development will be better understood in view of the attached drawings and the following detailed description of the illustrated embodiments.

DETAILED DESCRIPTION OF THE PREFERRED EMBODIMENT(S)

Figure 1:
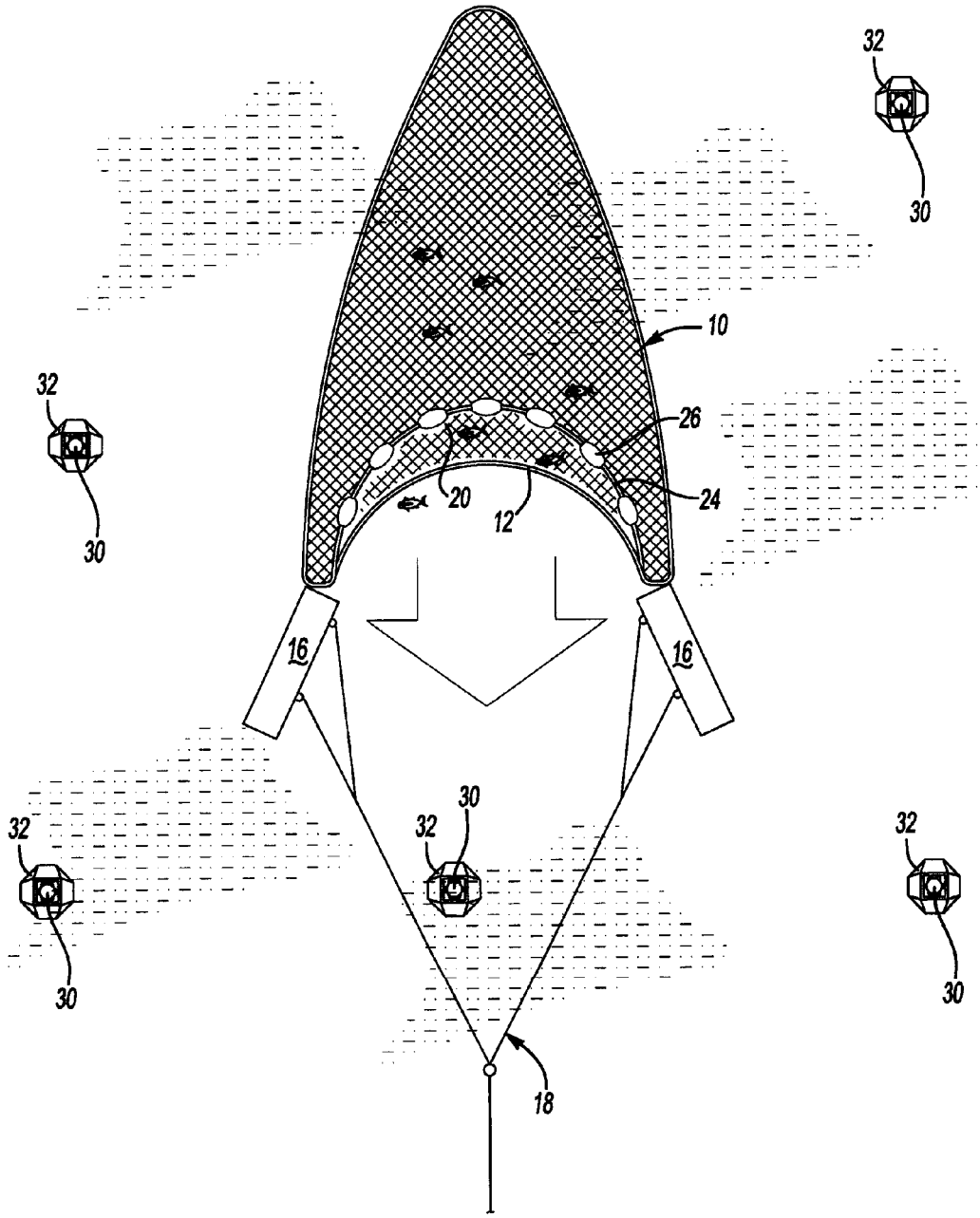
FIG. 1 is a schematic top plan view of a fishing trawler net being dragged over the surface of the ocean floor upon which a plurality of subsurface buoys are deployed.

Referring to FIG. 1, one example of a typical fishing trawler system is illustrated that scrapes along the bottom of the ocean floor to scoop fish into a fishing net 10. The net 10 has a mouth 12 that is flanked by heavy structural doors 16 that are positioned near the right and left sides of the net 10. The doors 16 may be secured to a bridle 18 that is pulled by a fishing trawler (not shown). The bottom leading edge of the net is dragged along the ocean floor by a foot rope 20 that may also be accompanied by a tickler chain (not shown). References to the "foot rope" should be understood in this application to refer to tickler chains, weights and other parts of the net that are associated with the foot rope 20. The net 10 may be further weighed down to assure that the net 10 and rigging scrapes the bottom of the ocean floor. An upper rope 24 is raised by floats 26 that hold the top of the mouth 12 of the net 10 open.

The foot rope 20 can damage the base 32, the tether, and the buoy 30 when dragged across the ocean floor. The buoy 30 and tether (not shown) may become entangled in foot rope 20. The net 10 may impinge upon the tether and draw the buoy 30 downwardly against the tendency of the buoy 30 to float and pull the tether upwardly. The buoy 30 is normally vertically oriented, but may assume an orientation that is perpendicular to the tether when the tether is held in a horizontal orientation by the net 10. The buoy 30 can become entangled in the foot rope 20 and be ripped from the tether.

In addition, the tether may be damaged or severed by the heavy door 16 at opposite ends of the net 10. The net depicted in the drawing is of conventional design, but is shown with a plurality of buoys 30 and bases 32 that are made according to the present invention.

Figure 2:
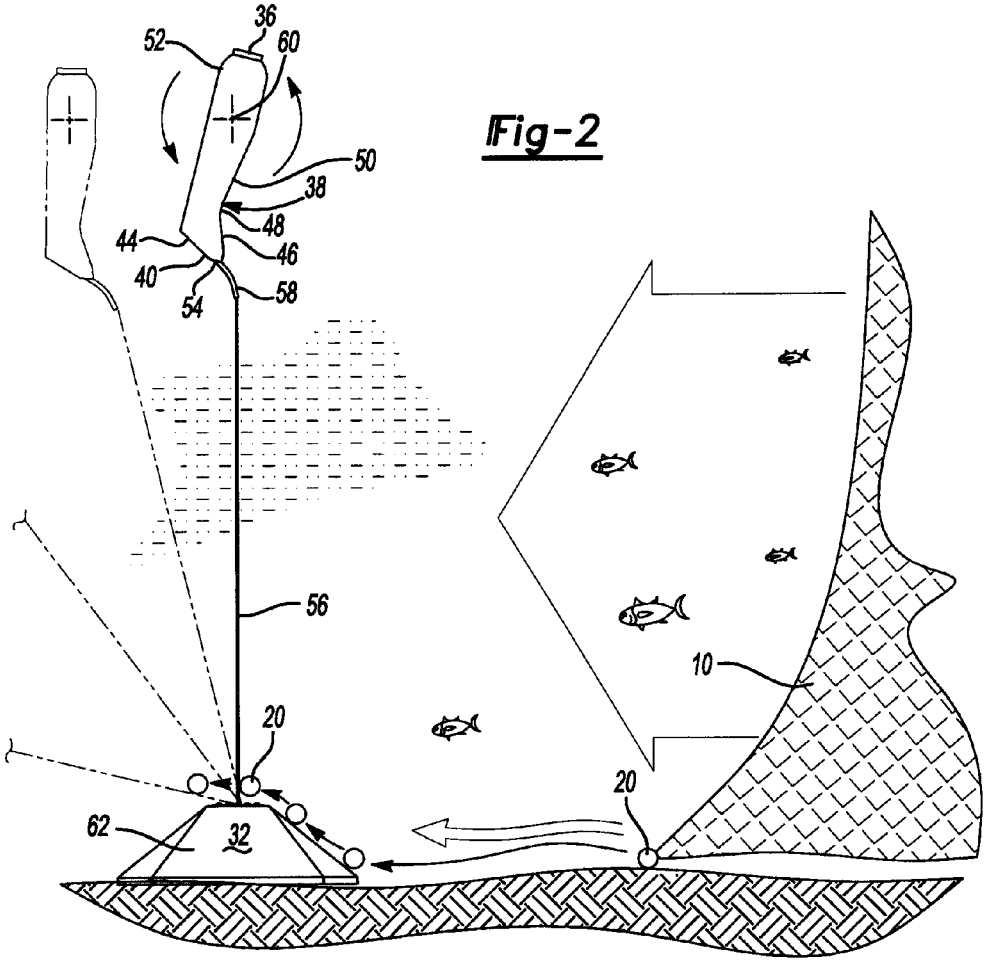
FIG. 2 is a fragmentary diagrammatic side elevation view of the fishing trawler net and a scoop point buoy secured to a base by a tether before the net engages the buoy, base or tether.
Figure 3:
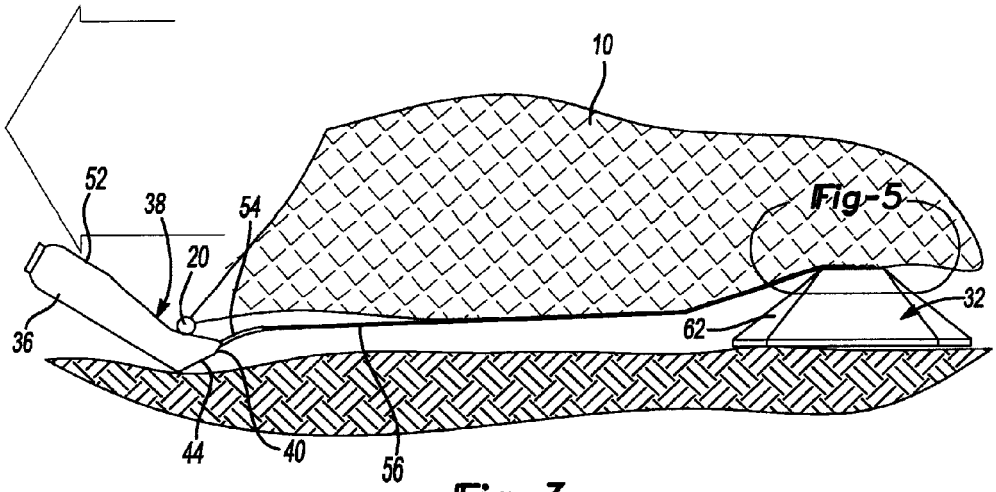
FIG. 3 is a fragmentary diagrammatic side elevation view showing a net engaging the scoop point buoy with the tether and buoy being forced to the ocean floor by the foot rope of the net.
Figure 4:
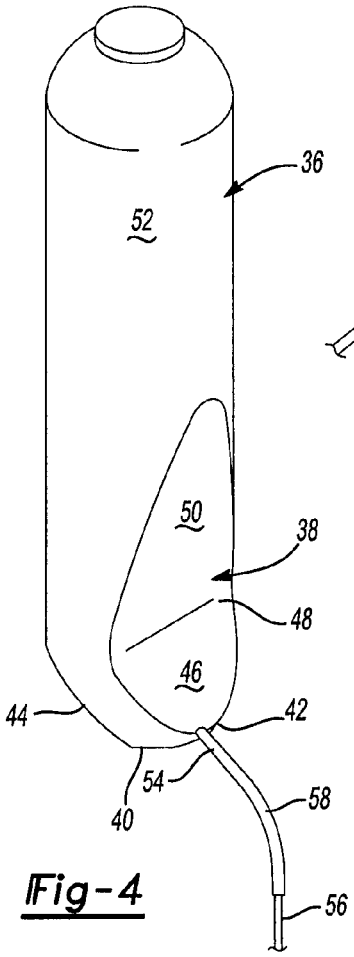
FIG. 4 is a perspective view of the scoop point buoy made according to one embodiment of the present invention shown attached to a cable or tether.

Referring to FIGS. 2-4, one embodiment of a buoy made according to the present invention that is referred to as a scoop point buoy 36 is illustrated. In FIG. 4, the scoop point buoy 36 is shown in isolation. In FIG. 2, the scoop point buoy 36 is shown in its normal floating orientation. In FIG. 3, the scoop point buoy 36 is shown with a fishing trawler net 10 being pulled over the buoy with the foot rope 20 holding the scoop point buoy 36 down on the ocean floor. An indentation 38 is defined at a lower end 40 of the buoy 36. An arcuate leading edge 42 provides a curved, relatively thin edge that is intended to minimize the area of the buoy 36 that may contact the foot rope 20 of the net 10. A lower surface 44 at the lower end 40 may be angularly oriented at an angle of approximately 60° relative to the longitudinal axis of the buoy 36. The angular orientation of the lower surface 44 may be between 40° and 80° relative to the longitudinal axis of the buoy 36.

The indentation 38 is formed by a lead-in ramp surface 46 that extends from the arcuate leading edge 42 to a transition area 48. The transition area 48 is a concave arcuate area that leads from the lead-in ramp surface 46 to a reorienting ramp surface 50. The lead-in ramp surface 46 provides a low profile to minimize the possibility of the buoy 36 being snagged on the foot rope 20. As the foot rope 20 moves up the lead-in ramp surface 46 to the transition area 44, as shown in FIG. 3, the buoy 36 may be held at between approximately 60° to 45° relative to the ocean floor. The foot rope 20, after passing over the transition area 44, engages the reorienting ramp surface 50 causing the buoy 36 to assume a more horizontal position relative to the ocean floor. In this position, the buoy 36 essentially lies down on the ocean floor to permit the net 10 and foot rope 20 to pass over the buoy 36. The buoy 36 has a cylindrical outer surface 52 as shown in the attached drawings. However, it may be possible to provide buoys having non-cylindrical outer surfaces, such as a polygonal cross-section, without deviating from the spirit and scope of the present invention. The buoy 36 may be solid or may be constructed as a housing corresponding to the outer surface 52.

A first end 54 of a cable 56 is secured to the lower end 40 of the buoy 36. The first end 54 may be secured at the narrowest point defined between the arcuate leading edge 42 and the lower surface 44. The cable 56 may be a sensor cable with electrical conductors. The electrical conductors may carry electrical signals between the buoy 36 and the base 32. Alternatively, a simple tether not including electrical conductors may be used as the cable 56. A stiffened section 58 approximately 2 inches in length may be provided at the first end 54 of the cable 56. The section 58 may be stiffened by a wire or sleeve. The stiffened section 58 facilitates orienting the buoy 36 as foot rope 20 is moved over the arcuate leading edge 42 and into the indentation 38.

As shown in FIG. 2, the scoop point buoy 36 is shown floating above the base 32. The buoy 36 is normally oriented in an angular orientation pivoted about a center of buoyancy 60. The stiffened section 58 tends to pivot the buoy 36 about the center of buoyancy 60.

Referring to FIGS. 3-6, one embodiment of a base 32 is illustrated. The base 32 may have a plurality of angularly oriented walls 62 that converge toward a top side 64. Alternatively, the walls 62 may be formed as a conical section with a circular or oval continuous wall. The top side 64 may support or receive an insert 66. The top side 64 may be cast welded, assembled or otherwise provided on the base 32 instead of using an insert. In the illustrated embodiment, the insert 66 is attached to the top side 64 of the base 32. A plurality of raised sections 70 on the insert 66 are partially spherical. Other shapes may be provided directly on the top side 64 or on the insert 66. Recessed areas 72 are provided between the raised sections 70. The cable 56 may be inserted through a central hole 74 so that a second end 76 of the cable 56 may be tied off or otherwise secured to the base 32.

Figure 5:
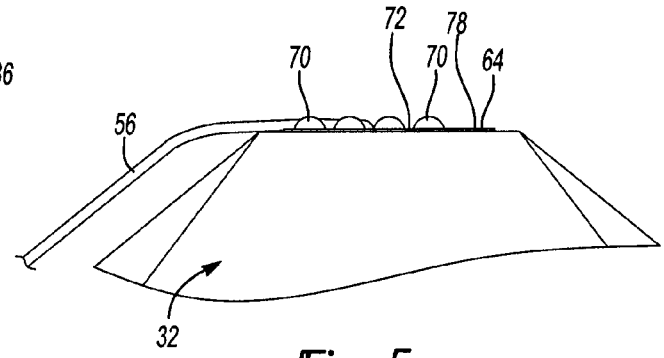
FIG. 5 is a magnified fragmentary side elevation view taken from the circle 5 in FIG. 3.

Referring to FIGS. 3 and 5, the cable 56 is shown being pulled laterally away from the base 32 with the cable 56 being received in the recesses 72 formed between the raised sections 70. The raised sections 70 prevent the cable 56 from being pinched or severed against the upper edges 78 of the angularly oriented walls 62 of the base 32. When the cable 56 is disposed in the recesses 72 between the raised portions 70, the doors 16 of the net 10 or the foot rope 20 are prevented from forcing the tether 56 against the top side 64 or upper edges 78 of the base 32. In this way, it is less likely that when the net 10 is drawn over the base 32 that the cable, or tether, 56 will be severed or damaged.

Figure 6:
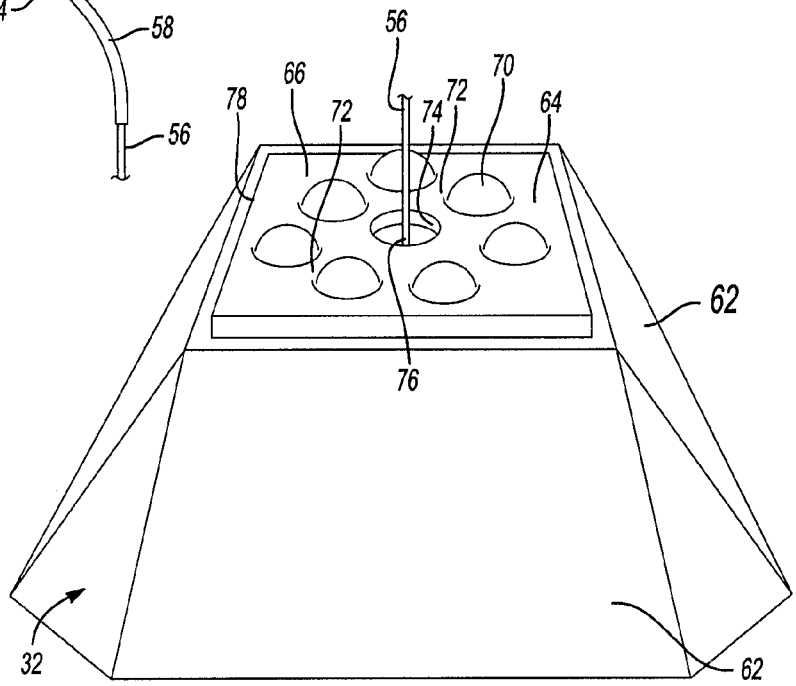
FIG. 6 is a perspective view of a base made according to one embodiment of the present invention.

Referring to FIGS. 5 and 6, the base 32 is shown to include the angularly oriented walls 62 at a top side 64 that may be provided with an insert 66. The top side 64 or insert 66 define a continuous upper surface 79 that is substantially planar in shape. The plurality of raised sections 70, or raised portions, are partially spherical in shape and are arrayed in a spaced, circular array about the tether 56. The raised sections 70 extend above the continuous upper surface 79 and define a plurality of recessed areas 72, or indentations.

In FIG. 6 the tether is shown in a first position with the tether 56 extending vertically upwardly from the base 32. In FIG. 5 the tether 56 is shown in a second position with a portion of the tether 56 being disposed between the raised portions. The portion of the tether 56 between the raised sections 70 extends parallel to the upper planar surface 79. In the second position the tether is prevented from being pinched against the upper surface 79 because the raised sections 70 extend above the upper surface to a greater extent than the width of the tether 56.

Figure 7:
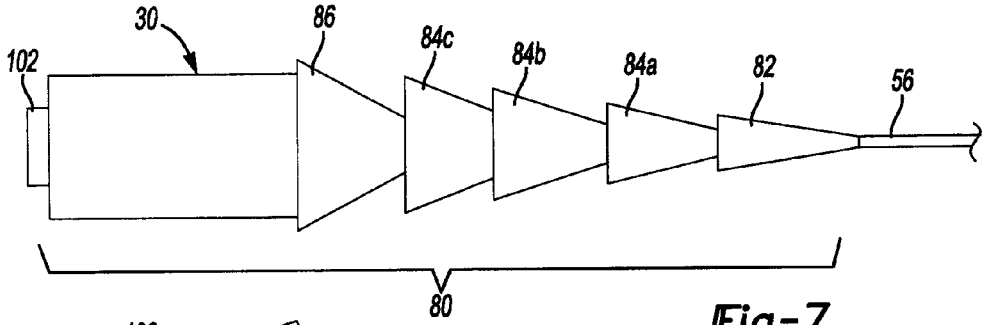
FIG. 7 is a side elevation view of a buoy and cable that are provided with a nested cone guard made according to one embodiment of the present invention.
Figure 8:
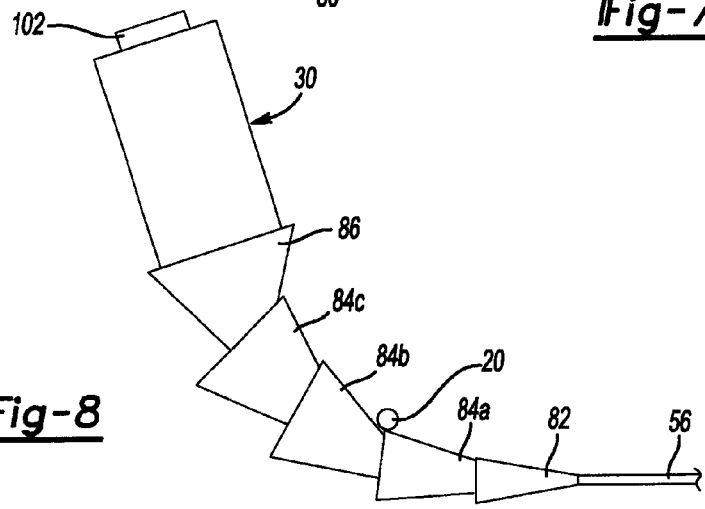
FIG. 8 is a side elevation view showing the buoy, tether and nested cone guard with the foot rope of a net engaging the nested cone guard.
Figure 9:
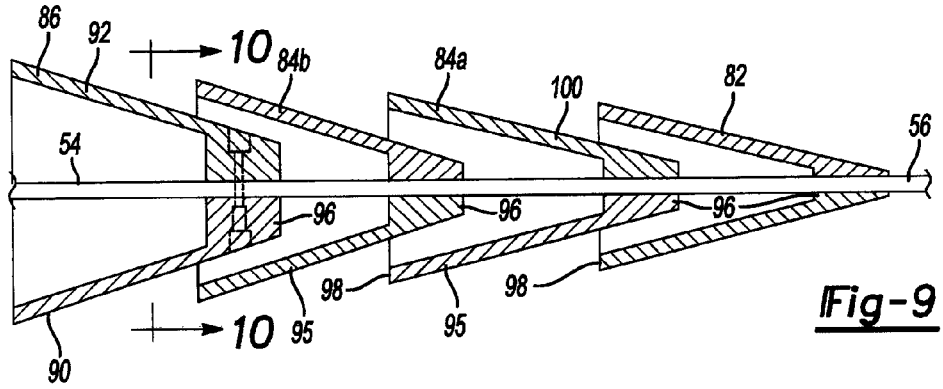
FIG. 9 is a vertical cross-sectional view of the nested cone guard.

Referring to FIGS. 7-10, an alternative embodiment of a buoy 30 is shown that is provided with a nested cone guard 80. The nested cone guard 80, as shown in FIG. 7, is disposed about the cable, or tether, 56 in such a way that it covers the first end 54 of the cable 56 where it is secured to the buoy 30. The nested cone guard 80 includes a leading cone 82 and a plurality of intermediate cones 84*a-c*. An end cone 86 is provided between the intermediate cones 84 and the buoy 30. The cones have an increasing maximum diameter as they progress from the leading cone 82 through each of the intermediate cones 84 to the end cone 86. The relative sizes of the cones is best illustrated in FIGS. 7-9.

As shown in FIG. 8, the foot rope 20 of a net 10 (not shown in FIG. 8) engages the leading cone 82 first and then rides over the intermediate cones 84*a-c* and end cone 86 that limit the deflection of the cable, or tether, 56 so that the buoy 30 does not wrap around the foot rope 20. The gradual curve established by the interaction of the cones 82-86 prevents the buoy 30 from becoming entangled with the foot rope 20. The cones 82-86 gradually reorient the buoy causing it to assume a generally horizontal orientation as the net 10 passes over the buoy 30.

Figure 10:
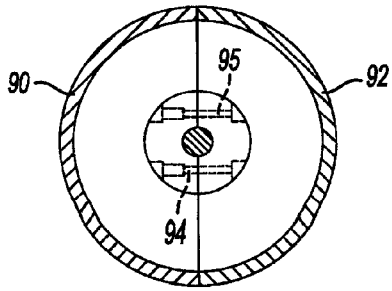
FIG. 10 is a horizontal cross-sectional view taken along the line 10-10 in FIG. 9.

Referring to FIGS. 9 and 10, according to one embodiment of the invention, the cones may be split into a first axially split cone 90 and a second axially split cone 92. The axially split cones 90 and 92 define fastener receptacles 94 in which a bolt or other suitable fastener may be inserted to hold the first and second axially split cones 90, 92 together. Alternatively, the cones, 82, 84 and 86 may be solid cones 95 through which the cable 56 is threaded. If a solid cone 95 is used, the cable 56 may be knotted or provided with another type of a securing device that secures the cones 82, 84 and 86 at spaced locations on the tether 56. In another embodiment, the cones 82, 84 may be attached to the end cone 86 and to adjacent cones without being directly attached to the cable 56.

As shown in FIG. 10, the base 96 of the cone is a solid portion that is generally radially aligned with the upper edge 98 of the next sequential cone. The arcuate bend permitted by the nested cone guard 80 is limited by engagement of the upper edge 98 of the cones with the outer surface 100 of the next adjacent cone.

As shown in FIGS. 7 and 8, a sensor 102, such as an acoustic sensor, may be provided on the buoy. The buoy 30 may be a housing for the sensor 102 and its associated electronic components. In addition, additional electronic components may be provided within the base 32. In this way, either the buoy 30 or the base 32 may provide protection for the electronic devices housed within either the buoy 30 or the base 32.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A buoy that is resistant to entanglement with a trawler net comprising:

an anchor;

a tether secured to the anchor on a first end of the tether;

a buoy having a lower end that is secured to the tether on a second end of the tether; and a plurality of cones that are disposed about the tether in a spaced relationship proximate the lower end of the buoy, wherein the lower end of the buoy is nested within a first cone, wherein the first cone is nested within at least one additional cone, and wherein the cones are nested to prevent the buoy from becoming entangled with the trawler net as the trawler net traverses the tether and the buoy by reorienting the buoy to a generally horizontal orientation.

2. The buoy of claim 1 wherein the additional cone is a second cone that is nested within a third cone.

3. The buoy of claim 1 wherein the first cone engages the buoy and the additional cones engage the next cone closer to the buoy when the trawler net traverses the tether and the cones.

4. The buoy of claim 1 wherein the tether has a longitudinal axis that is normally vertically oriented when the buoy is allowed to float, and the cones prevent the buoy from being oriented relative to the longitudinal axis of the tether that would result in entanglement with the trawler net.

5. The buoy of claim 1 wherein the cones provide a segmented ramp surface that is traversed by the trawler net.

6. An anchor and a tether attached to the anchor, in combination, comprising:

a body having an upper surface and a plurality of raised portions that are arranged in a circular array that extends above the upper surface and define a plurality of indentations; and wherein the tether is secured to the body and extends above the upper surface in a first position, and wherein the tether may be received in the indentations when the tether is extended across the upper surface of the body and partially parallel to the top surface in a second position, wherein a portion of the tether is disposed between the raised portions in the second position to prevent the tether from being pinched against the planar upper surface.

7. The combination of claim 6 wherein the body has an outer wall that raises a foreign object over the body as the foreign object traverses the body in a lateral direction.

8. An anchor and a tether attached to the anchor, in combination, comprising:

a body having an upper surface that defines a plurality of indentations between a plurality of raised portions; and wherein the tether is secured to the body and extends above the upper surface in a first position, and wherein the tether may be received in the indentations when the tether is extended across the upper surface of the body in a second position, wherein the raised portions prevent the tether from being pinched against the body, wherein the upper surface of the body is provided by an insert that is secured within a recess defined by an outer wall of the body, wherein the insert fills the recess defined by the wall.

9. The combination of claim 8 wherein the indentations between the raised portions are provided on the insert.

10. The combination of claim 6 wherein the raised portions of the upper surface are partially spherical in shape.

11. A buoy system comprising:

a base having a top side and a wall extending about the base;

a guard is disposed on the top side that defines a plurality of indentations between raised portions that extend above the wall;

a tether attached on a lower end to the base;

a buoy is attached to an upper end of the tether at a spaced location relative to the base; and means for reorienting the buoy to a generally horizontal orientation in the event an object is dragged over the base, tether and buoy, wherein the tether may be received in the indentations in the event the tether is pressed against the top side of the base to protect the tether from being pinched against the wall extending about the base, and wherein the means for reorienting the buoy prevents the buoy from becoming entangled with the object as the object traverses the base, the tether and the buoy.

12. The buoy system of claim 11 wherein the means for reorienting the buoy includes a plurality of cones that are disposed about the tether in a spaced relationship proximate the lower end of the buoy, wherein the lower end of the buoy is nested within a first cone, wherein the first cone is nested within at least one additional cone, and wherein the cones cooperate to prevent the buoy from becoming entangled with the object as the object traverses the tether and then the buoy by reorienting the buoy to a generally horizontal orientation.

13. The buoy system of claim 12 wherein the first cone engages the buoy and the additional cones engage the next cone closer to the buoy when the object traverses the tether and the cones.

* * * * *